US007093784B2

(12) United States Patent
Smith

(10) Patent No.: US 7,093,784 B2
(45) Date of Patent: Aug. 22, 2006

(54) UNIVERSAL SHIFT APPARATUS AND METHOD FOR SWIMMING POOL COVER ASSEMBLY

(75) Inventor: Lanny R. Smith, Alpine, UT (US)

(73) Assignee: Coverstar, Inc., Provo, UT (US)

( * ) Notice: Subject to any disclaimer, the term of this patent is extended or adjusted under 35 U.S.C. 154(b) by 8 days.

(21) Appl. No.: 10/686,111

(22) Filed: Oct. 14, 2003

(65) Prior Publication Data

US 2005/0087643 A1 Apr. 28, 2005

(51) Int. Cl.
*B65H 75/30* (2006.01)

(52) U.S. Cl. ..... 242/394.1; 242/919; 192/69.1

(58) Field of Classification Search ..... 242/388.6, 242/394.1, 919; 4/502; 192/69.1
See application file for complete search history.

(56) References Cited

U.S. PATENT DOCUMENTS 2,842,231 A * 7/1958 Pepper ..... 188/291
2,884,105 A * 4/1959 Tomlinson ..... 192/48.91
3,721,324 A * 3/1973 Schweizer ..... 192/48.91
4,686,717 A * 8/1987 MacDonald et al. ..... 4/502
4,811,433 A * 3/1989 MacDonald et al. ..... 4/502
4,815,152 A * 3/1989 MacDonald et al. ..... 4/502
5,184,356 A * 2/1993 Lof et al. ..... 4/502
5,327,590 A * 7/1994 Last ..... 4/502
5,524,302 A * 6/1996 Ragsdale et al. ..... 4/502
6,431,488 B1 * 8/2002 Zemla et al. ..... 242/388.6

* cited by examiner

*Primary Examiner*—Kathy Matecki
*Assistant Examiner*—Sang Kim
(74) *Attorney, Agent, or Firm*—Bryan G. Pratt; Rader, Fishman & Grauer PLLC.

(57) ABSTRACT

A universal shift apparatus and method for a swimming pool cover motor has a rotatable drive shaft and a rope attached to the end of the swimming pool cover. A reel element collects the rope, and a roll-up element collects the swimming pool cover. A gear drive assembly on the rotatable drive shaft drives the reel element in a first rotational direction as the shaft rotates in a first direction and drives the roll-up element in a second rotational direction as the shaft rotates in a second direction. A shift assembly is associated with the gear drive assembly to selectively reverse the first rotational direction of the wind-up reel element and to selectively reverse the second rotational direction of the roll-up element.

37 Claims, 10 Drawing Sheets

UNIVERSAL SHIFT APPARATUS AND METHOD FOR SWIMMING POOL COVER ASSEMBLY

FIELD OF INVENTION

The present disclosure relates to swimming pools, and, more particularly, to a universal shift apparatus and method for a swimming pool cover assembly.

BACKGROUND

Swimming pool covers are often used for keeping the water free of trash, to shield the water from sunlight that could degrade protective chemicals in the water and for other purposes. Automatic pool covers are often preferable over manually-operated covers, because the cover can be easily extended when the pool is not in use and retracted during use. In most cases, a pool cover box is located at one end of the pool to hold the pool cover system.

Referring to FIG. 1A, an abstract view of a typical pool cover system 10 is shown. System 10 includes a motor 12, a drive shaft 14 extending from motor 12, a wind-up reel 16 for collecting a rope 18, a gear box 20, a swimming pool cover 22 and a roll-up tube 24 on which to wind the cover 22. Rope 18 extends to a remote pulley system (not shown) and then back to a leading edge of the cover 22. Reel 16 and a roll-up tube 24 are usually mounted in a free-wheeling fashion on drive shaft 14 to turn independently therefrom. Gear box 20 includes mechanisms to engage either the reel 16 or the roll-up tube 24, depending on whether the cover 22 is to be extended or retracted.

By turning drive shaft 14 in direction A, clockwise relative to motor 12 as shown, shaft 14 engages the gear mechanism in gear box 20 to drive reel 16 in direction A. This action winds rope 18 on reel 16, thereby causing cover 12 to be extended outward over the pool (not shown). Alternately, by rotating drive shaft 14 in direction B, counter-clockwise relative to motor 12, roll-up tube 24 is engaged by drive shaft 14 via the mechanism in gear box 40, so that the pool cover 22 is retracted on tube 24 and removed from above the pool. The pool cover system 10 shown in FIG. 1A is referred to as a right-hand system, since the pool cover motor is located on the right side in the pool cover box (not shown).

Sometimes the layout of the pool and its surroundings dictate that the pool cover motor be located on the left-hand side of the pool cover box, as shown in FIG. 1B. The pool cover system 30 shown in FIG. 1B is referred to as a left-hand system, since the pool cover motor 32 is situated on the left side of the pool cover box. As in FIG. 1A, the drive shaft 34, reel 36, rope 38, cover 42 and roll-up tube 44 are substantially identical to the corresponding elements shown in FIG. 1A. The main distinction is that different mechanisms are needed in gear box 40, compared to the mechanisms in gear box 20, in order for reel 36 and roll-up tube 44 to be engaged to rotate in directions opposite to the directions of rotation in the right-hand pool cover system shown in FIG. 1A.

Accordingly, in FIG. 1B, if the drive shaft 34 rotates in a direction C, counter-clockwise to motor 32, this action turns reel 16 in direction C to collect the rope 38 on reel 36. Alternately, if drive shaft 34 rotates in a direction D, clockwise to motor 32, then cover 42 is retracted onto roll-up tube 44.

FIG. 2A shows a gear box 20 having a prior art gear mechanism 50 for the right-hand system in FIG. 1A. A single dog gear 52 is fixedly mounted to roll-up tube 24 (shown in FIG. 1A). Another single dog gear 54 is fixedly mounted to reel 16 (shown in FIG. 1A). A double dog gear 56 is rotatably mounted on drive shaft 14 to be free-wheeling along shaft 14. A shear pin 57 is secured into drive shaft 14 to extend orthogonally outward from the drive shaft 14. The shear pin 57 extends into a slanted slot 58 formed in double dog gear 56.

Accordingly, as drive shaft 14 is rotated in direction A, double dog gear 56 is moved along drive shaft 14 in the direction E, so that double dog gear 56 couples single dog gear 54 to drive reel 16 and collect rope 18, shown in FIG. 1A. Alternately, as drive shaft 14 is rotated in direct B, double dog gear 56 is moved along drive shaft 14 in the direction F, engaging single dog gear 52. This action drives the roll-up tube 24 and collects the pool cover 22, shown in FIG. 1A.

Similarly, FIG. 2B shows gear box 40 having a prior art gear mechanism 60 that drives the left-hand system shown in FIG. 1B. A single dog gear 62 engages roll-up tube 44, and a single dog gear 64 engages reel 36. A double dog gear 66 is mounted to free-wheel on drive shaft 34. When drive shaft 34 rotates in direction C, double dog gear 66 is forced by shear pin 67 along shaft 34 in direction H. This engages the reel 36 to collect the rope 38, shown in FIG. 1B. When drive shaft 14 rotates in direction D, double dog gear 66 is forced by shear pin 67 along shaft 34 in direction G. This engages the roll-up tube 44 to retract cover 42, as shown in FIG. 2B.

Accordingly, prior art systems involve a swimming pool builder using both right-hand and left-hand motor systems, including different gear boxes, in order to work with various pool layouts and the requirements of customers. Consequently, both right-hand and left-hand types of motor systems must be readily supplied by a pool equipment supplier, adding to the supplier's inventory demands. Moreover, it is difficult to forecast which type of system will be in greater demand, resulting in over-supply and under-supply of right and left-hand motor systems. Furthermore, complex prior art gear boxes, such as shown in FIGS. 2A and 2B, are relatively expensive and are maintenance-intensive.

A pool cover motor system may also be equipped with a torque limiter separately mounted, so that, in the event the cover or one of its components becomes jammed or stuck, the motor or other parts of the pool cover motor system will not be damaged. Typically, torque limiter apparatus includes some type of device that slips relative to the rotatable shaft in the event that a predetermined torque limit on the device is exceeded. However, adding a torque limiter to the motor system also adds extra cost to the manufacture of the motor system.

SUMMARY

In one exemplary implementation, a universal shift apparatus and method for a swimming pool cover motor has a rotatable drive shaft and a rope attached to the end of the swimming pool cover. A reel element collects the rope, and a roll-up element collects the swimming pool cover. A gear drive assembly on the rotatable drive shaft drives the reel element in a first rotational direction as the shaft rotates in a first direction and drives the roll-up element in a second rotational direction as the shaft rotates in a second direction. A shift assembly is associated with the gear drive assembly to selectively reverse the first rotational direction of the wind-up reel element and to selectively reverse the second rotational direction of the roll-up element.

In another exemplary embodiment, a method is provided for adapting a reel apparatus for a swimming pool cover motor having a rotatable drive shaft and a rope attached to the end of the swimming pool cover. The method comprises collecting the rope on a reel element and collecting the swimming pool cover on a roll-up element. The reel element is driven in a first rotational direction as the shaft rotates in a first direction. The roll-up element is driven in a second rotational direction as the shaft rotates in a second direction. The first rotational direction of the wind-up reel element and the second rotational direction of the roll-up element are reversed using a shift assembly.

BRIEF DESCRIPTION OF THE DRAWINGS

The above-mentioned features and other features and advantages of this disclosure will become more apparent and the disclosure will be better understood by reference to the following description of an exemplary implementation taken in conjunction with the accompanying drawings, wherein.

Throughout the drawings, identical reference numbers may designate similar, but not necessarily identical, elements. The examples herein illustrate selected implementations of the disclosure in certain forms, and such exemplification is not to be construed as limiting the scope of the disclosure in any manner.

DETAILED DESCRIPTION

The present apparatus and method described herein make it possible to have a universal shift or transposer mechanism that can be employed as either a right-hand system or a left-hand system for pool cover motor assemblies. The present apparatus and method uses the same gear mechanism for both right-hand and left-hand systems, only requiring a change in the orientation of one component in the gear mechanism to make the conversion. This simple gear structure eliminates the need to stock separate right-hand and left-hand pool cover motor assemblies, substantially reducing the inventory required for pool cover motor assemblies.

In addition, the embodiments of the present invention described herein incorporate a torque limited connected to the above gear mechanism. This arrangement utilizes the torque limiter to function both to limit the torque applied to the pool cover motor assembly and to connect the gear mechanism to the drive shaft of the motor. This structure substantially simplifies having a torque limiter as part of the system and reduces the cost of manufacturing accordingly.

Right-hand Pool Cover Motor System

Figure 3:
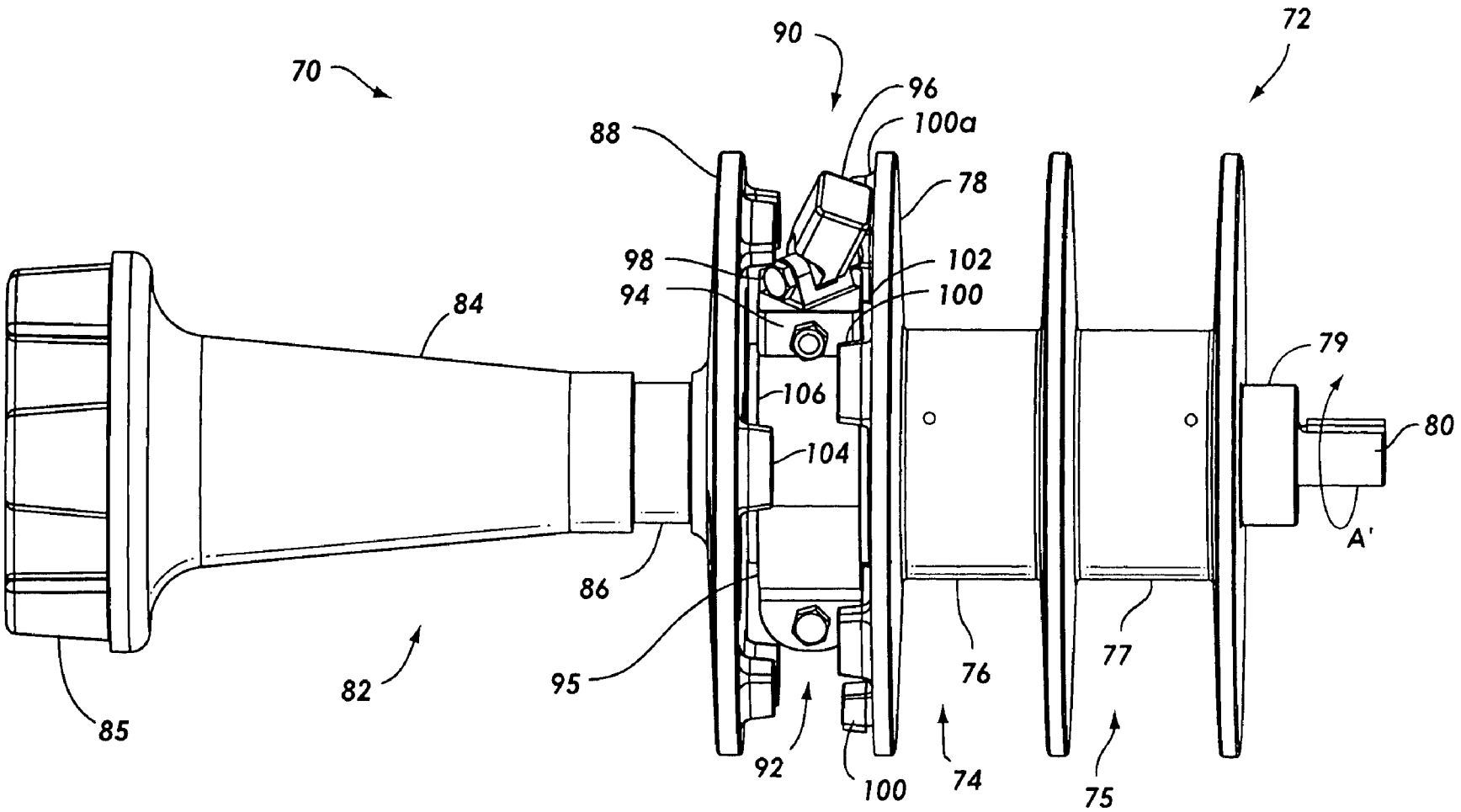
FIG. 3 is a plan partial view of a right-hand pool cover motor assembly, with a shift arm in a first position, in accordance with the present disclosure.

Referring now to the drawings, and more particularly to FIG. 3 illustrates a portion of a right-hand pool cover motor system 70 according to one exemplary implementation. Motor system 70 includes a rope reel unit 72 (also referred to as "reel unit 72") having dual side-by-side reels 74, 75 for collecting ropes on spindles 76, 77 from each of the two sides of a pool cover (not shown). Reel unit 72 is mounted on a bushing 79 to freely turn on a drive shaft 80 which comes from a pool cover motor (not shown). One side of reel unit 72 comprises a reel disc 78, for interfacing with the gear mechanism to be discussed later.

A drive cone unit 82 is also mounted to freely turn on drive shaft 80 and attached by a roll-up collar 85 to a roll-up tube to the left of drive cone unit 82 (not shown) for collecting a pool cover. Drive cone unit 82 includes a cone piece 84 that is connected to a neck piece 86 and then to a drive cone disc 88. Drive cone disc 88 interfaces with the gear mechanism 90, as discussed below. As can be seen the pool cover motor system 70 is a right-hand system because the pool cover motor would be on the right side with the roll-up tube on the left hand side of the system 70.

A gear mechanism 90 is shown between reel disc 78 and drive cone disc 88. The gear mechanism includes a torque limiter 92 resistively mounted on drive shaft 80 by clamp ring 95, to be discussed later. A shift base 94 is mounted on torque limiter 92 and a shift arm 96 pivotally mounted on shift base 94. Reel disc lugs 100 are spaced around the surface 102 of reel disc 78 that faces toward gear mechanism 90. Likewise drive cone disc 88 includes drive cone disc lugs 104 spaced around the surface 106 of drive cone disc 88 that faces toward gear mechanism 90.

Figure 1A:
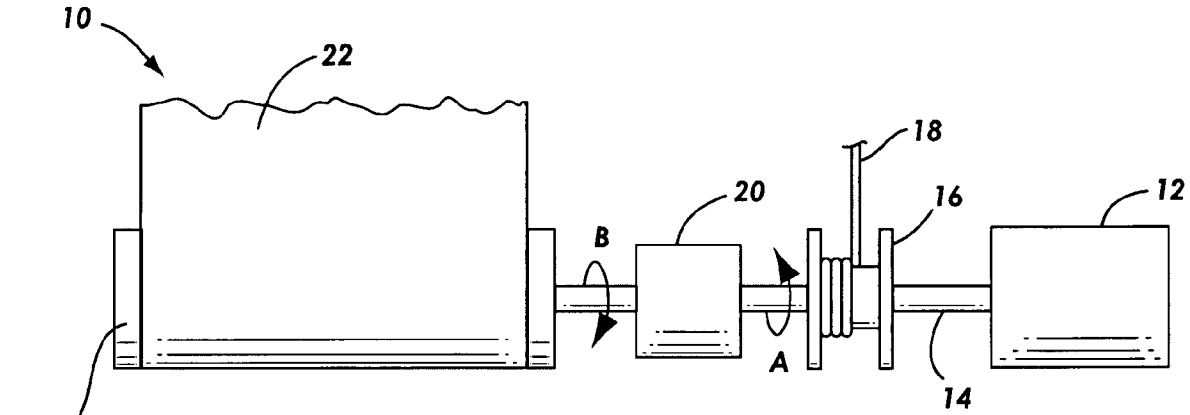
Fig. 1A Prior Art
FIGS. 1A and 1B are generalized top views of right-hand and left-hand swimming pool cover motor assemblies.
Figure 1B:
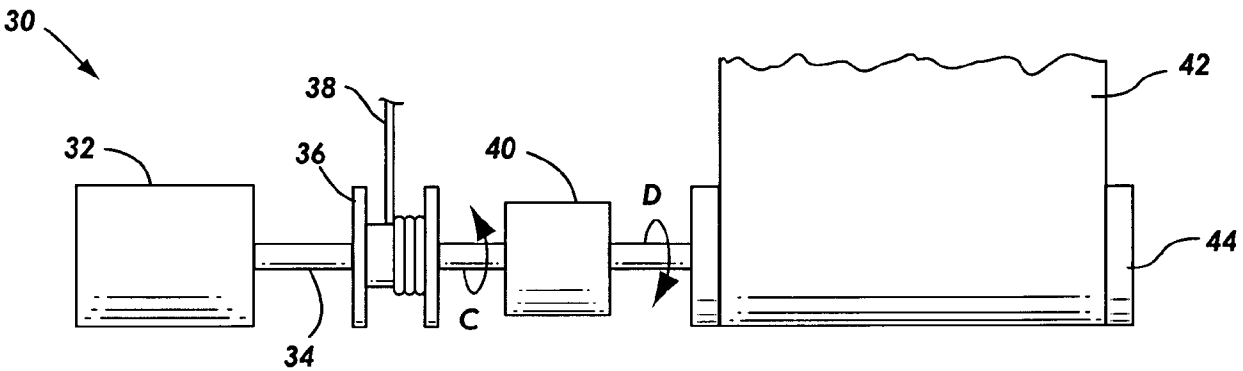
Fig. 1B Prior Art
Figure 2B:
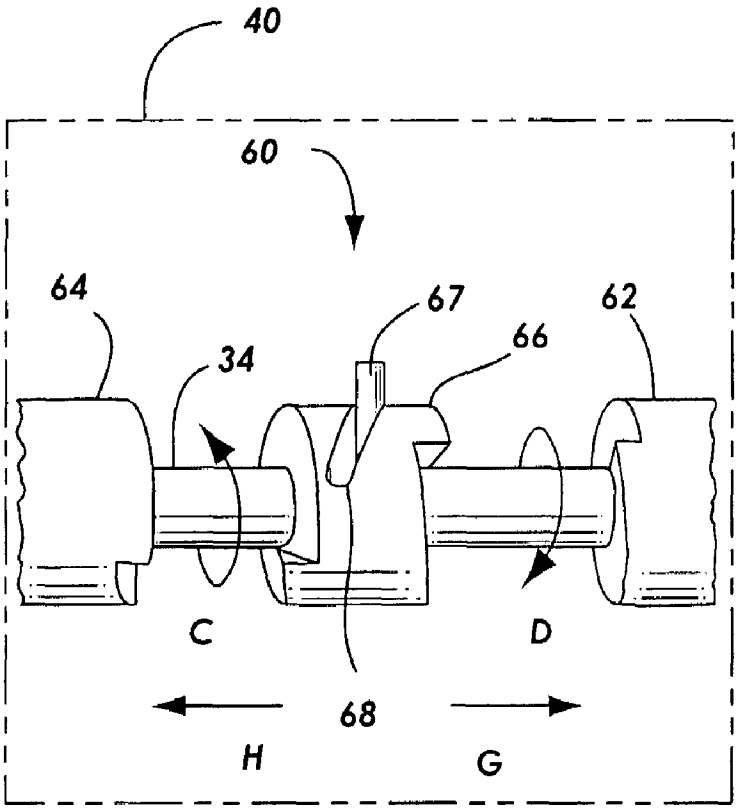
Fig. 2B Prior Art
FIGS. 2A and 2B are schematic representations of prior art gear mechanisms in the pool cover motor assemblies shown in FIGS. 1A and 1B.
Figure 2A:
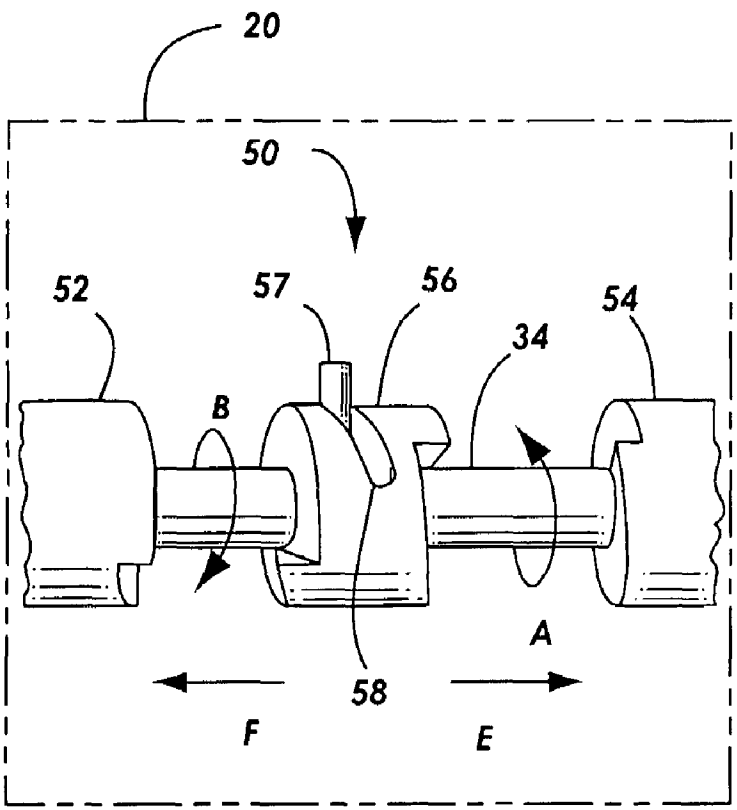
Fig. 2A Prior Art

Gear mechanism 90 includes a shift arm 96 (also referred to as "shift member 96") mounted on a pivot mount 98 on shift base 94. The shift arm 96 pivots at 45 degrees relative to the axis of the drive shaft 80. The pivot action of shift arm 96 responds to the pull of gravity to fall against the reel disc lugs 100 as the drive shaft 80 rotates in the direction A (clockwise, looking in from the end of shaft 80) as shown in FIG. 3. This pivot action rotates torque limiter 92 that is fixedly mounted on drive shaft 80. The rotation of torque limiter 92 places shift arm 96 behind and in contact with reel disc lug 100*a*, thereby driving reel unit 72 also in direction A'. This rotation causes the rope (not shown) to wind up on reel unit 72 by coming in at the bottom of reels 76 and 77, similar to that shown in FIG. 1A.

Figure 4:
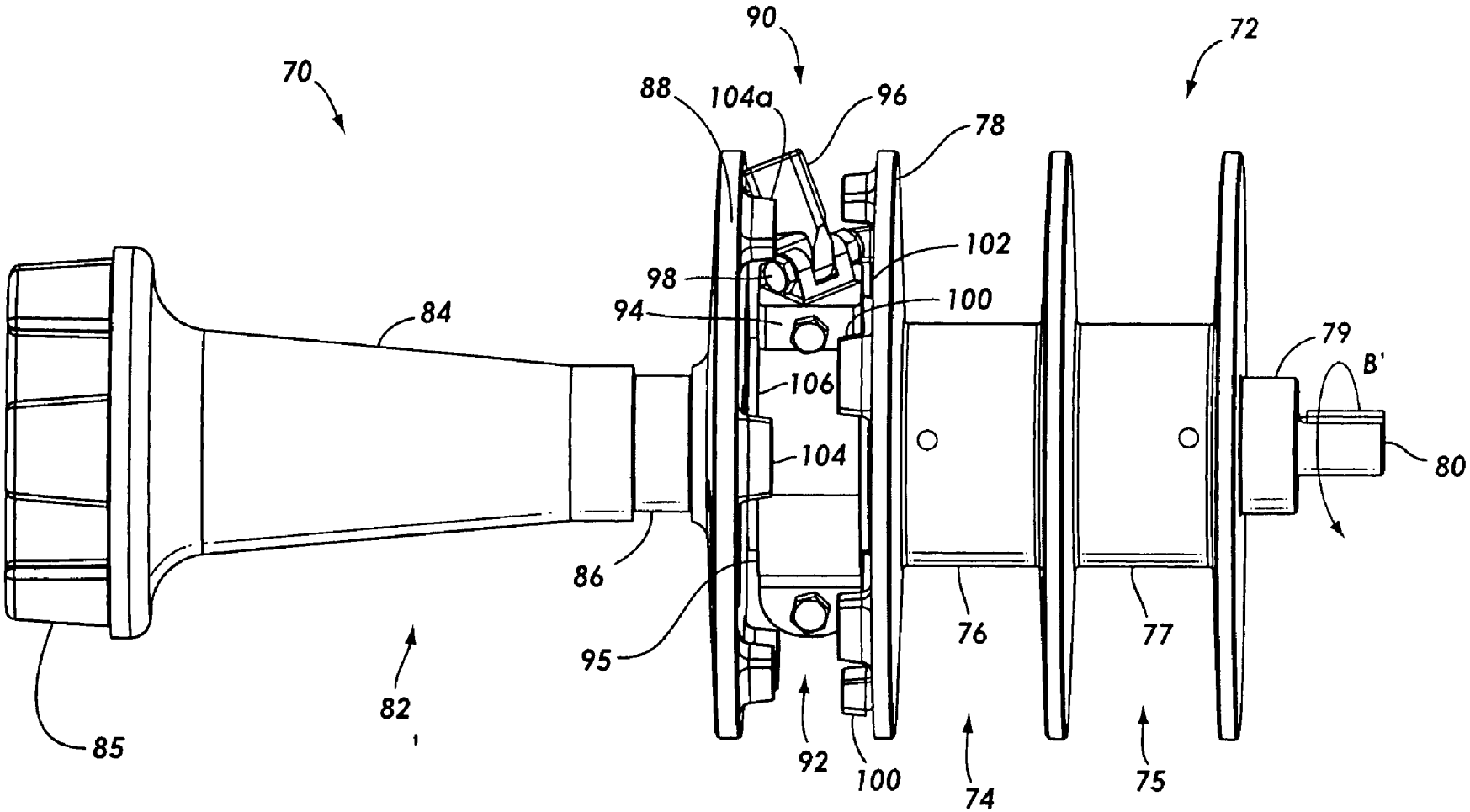
FIG. 4 is a plan partial view of the right-hand pool cover motor assembly of FIG. 3 with the shift arm in a second position, in accordance with the present disclosure.

Referring now to FIG. 4, the same portion of a pool cover motor system 70 is shown with the same components shown and described with respect to FIG. 3. However, in FIG. 4 the drive shaft 80 is shown rotating in the direction B' (counter-clockwise, looking in from the end of the shaft 80). This rotational direction B' causes torque limiter 92 to rotate in the B' direction. The pull of gravity causes shift arm 96 to shift behind and in contact with lug 104*a* on cone drive disc 88 thereby causing it to rotate. This rotation of drive disc 88 causes cone drive 82 and roll-up tube (not shown) to rotate in the B direction, thereby collecting the pool cover that comes in at the top of roll-up tube, similar to that shown in FIG. 1A.

The foregoing description shows the simplicity and genius of the gear mechanism 90. The reel unit 72 and the drive cone unit 82 are separately driven by the shift arm 96, depending on the direction of rotation of drive shaft 80. The only moving part is shift arm 96, which simply pivots one of two directions to make contact with one of the appropriate lugs. The direction of rotation determines whether the reel unit 72 is to be driven to collect the rope, thereby extending the pool cover, or whether the drive cone unit 82 is to be driven to retract the pool cover.

Figure 5:
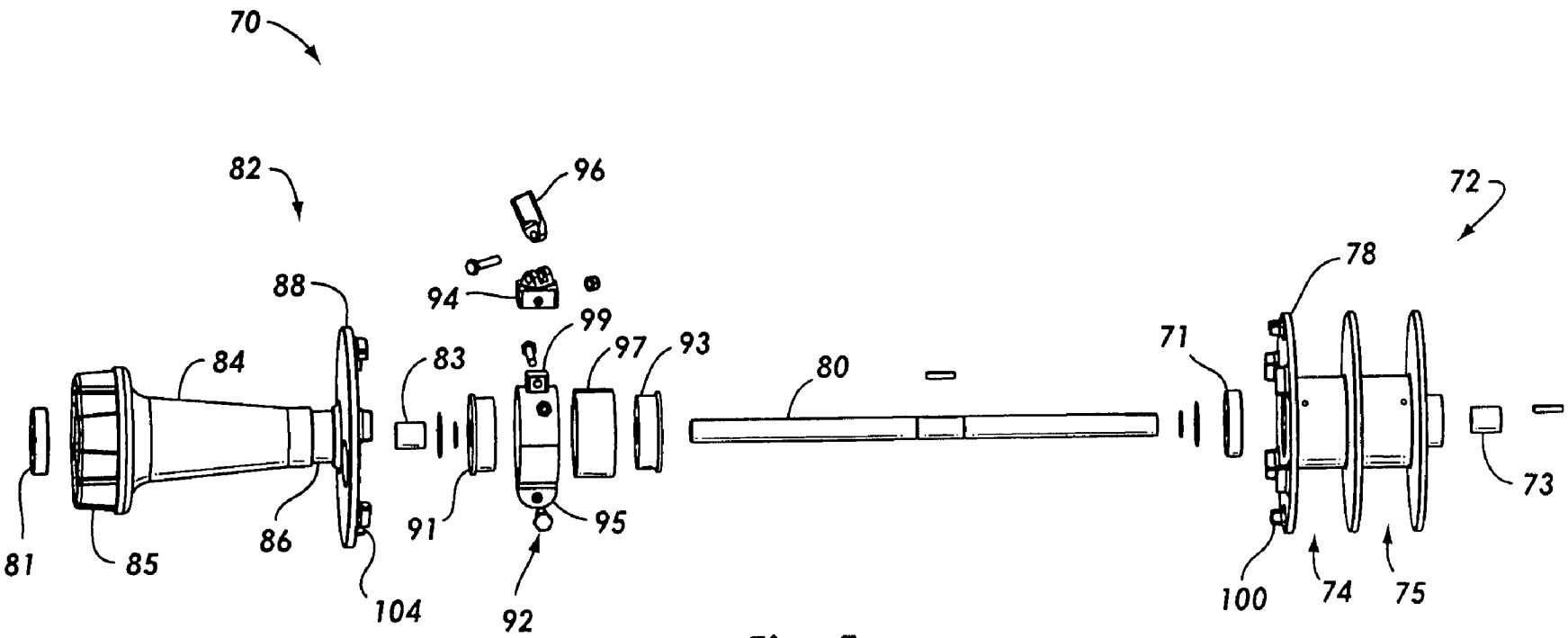
FIG. 5 is a blown-up schematic view of the right-hand pool cover motor assembly shown in FIGS. 3 and 4.

FIG. 5 provides an exploded view of the pool cover motor system 70. Drive cone unit 82 includes a roll-up tube collar 85 that connects to the roll-up tube (not shown). Drive cone unit also includes cone piece 84, neck piece 86 and drive cone disc 88, previously discussed. A plastic bushing 81 and a metal bushing 83 attach the drive cone unit 82 to freely turn on drive shaft 80. Likewise, reel unit 72 is attached to freely turn on drive shaft 80 by a plastic bushing 72 and a metal bushing 73.

The gear mechanism 90 is fixedly secured to drive shaft 80 by torque limiter 92 using the split hubs 91 and 93. A split ring 97 is mounted on split hubs 91 and 93 and the combination is clamped onto the drive shaft 80 by clamp ring 95. The torque limiter 92 has a base mount 99 on which the shift base 94 is secured. The shift arm 96 is pivotally secured on the shift base 94. Various nuts, bolts, washers, pins and screws are shown in FIG. 5 having obvious functions of connecting the components shown.

Figure 6A:
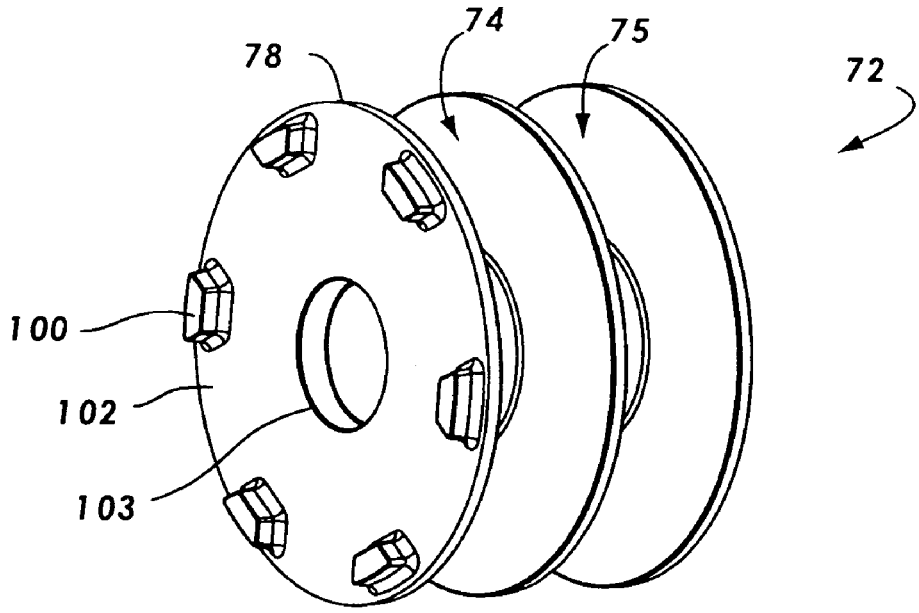
FIGS. 6A and 6B are perspective and plan views of the reel assembly of the pool cover motor assembly shown in FIGS. 3 and 4.
Figure 6B:
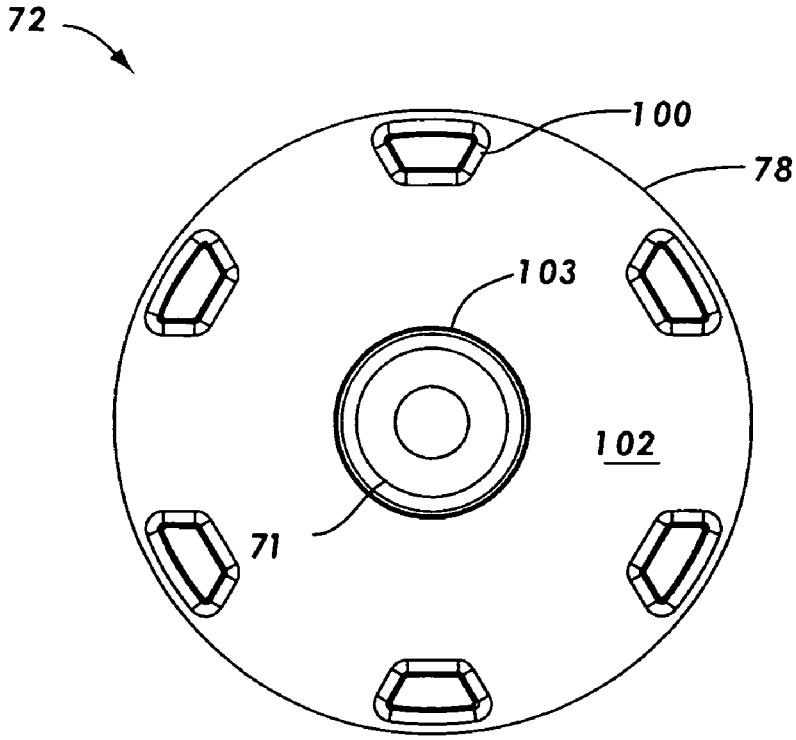

FIGS. 6A and 6B show the structure of the reel disc 78 more clearly. Dual reels 74 and 75 are connected together on the same axis. The inner surface 102 of reel disc 78 has reel disc lugs 100 spaced around the periphery of surface 102. A circular opening 103 extends through the center of reel disc 78 to accept bushings 71 and 73, shown in FIG. 5. Bushing 71 is also shown in place in FIG. 6B.

Figure 7A:
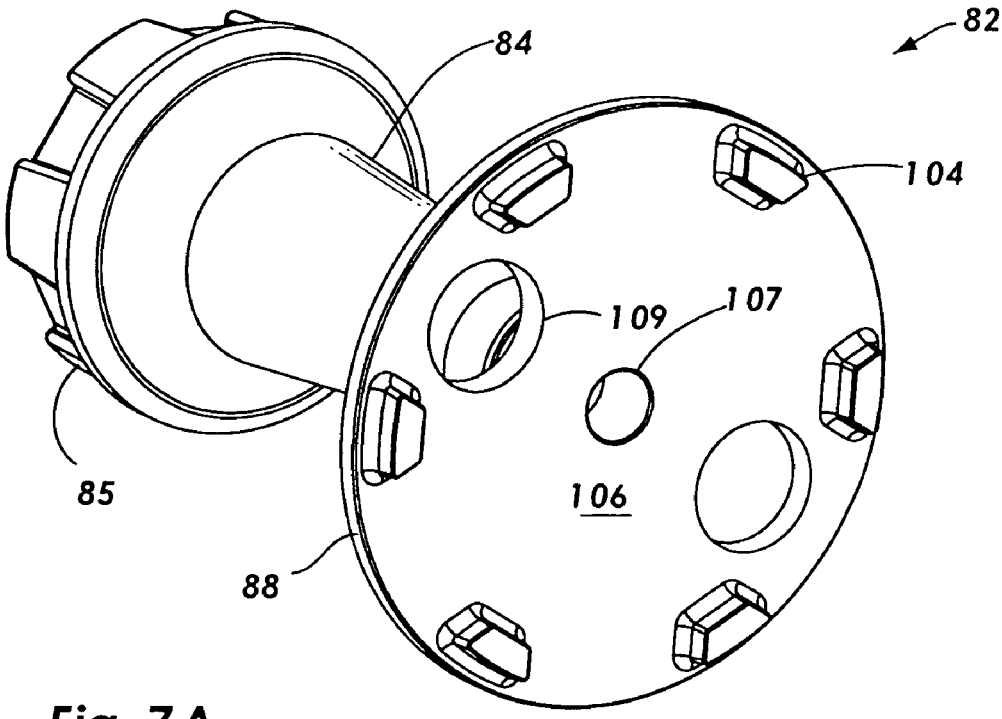
FIGS. 7A and 7B are perspective and plan views of the drive cone assembly of the pool cover motor assembly shown in FIGS. 3 and 4.
Figure 7B:
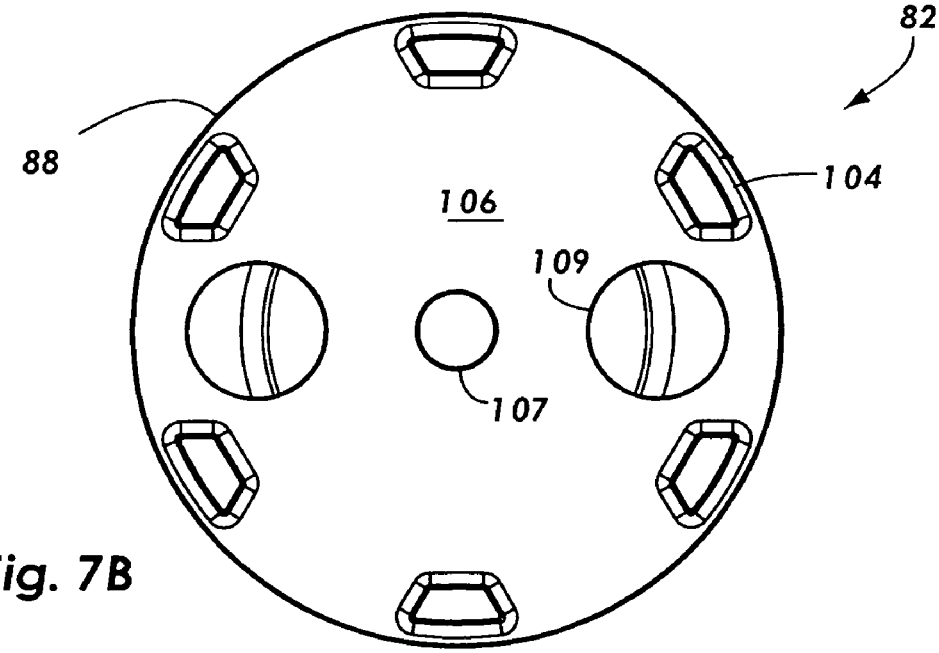

FIGS. 7A and 7B show the structure of the drive cone unit 82 more clearly. Roll-up tube collar 85 is connected to cone piece 84. The drive cone disc 88 includes inner surface 106 with several drive cone disc lugs 104 spaced around the periphery. A circular opening 107 extends through the drive cone unit 82 to accept drive shaft 80. Holes 109 are disposed in drive cone disc 88 for access purposes.

Figure 8A:
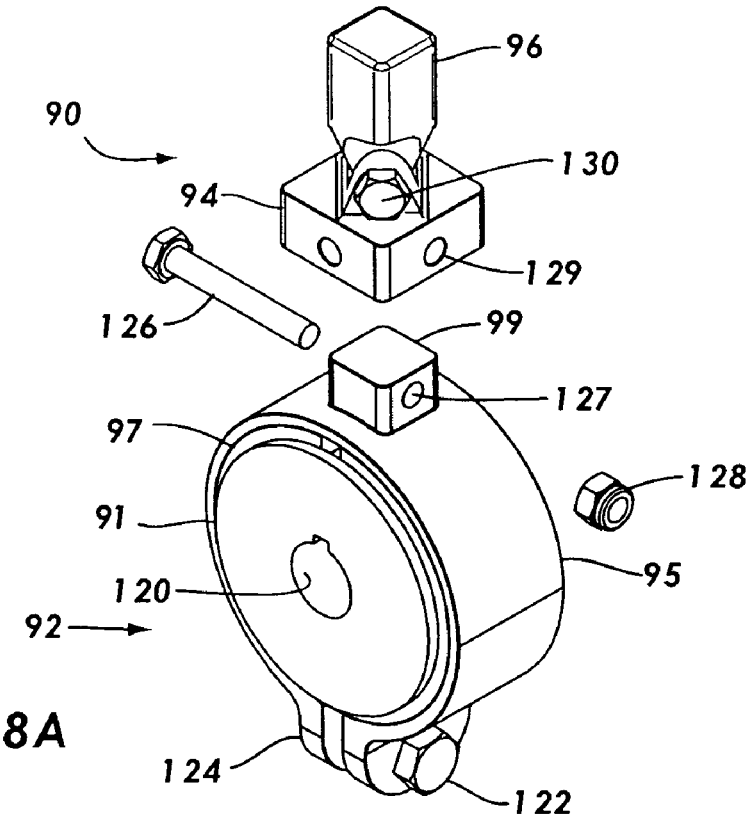
FIG. 8A is an exploded perspective view of the torque limiter of the pool cover motor assembly shown in FIGS. 3 and 4.

FIG. 8A shows the torque limiter 92 and gear mechanism 90 in more detail. The torque limiter 92 includes split hubs 91 and 93, also shown in FIG. 5. Only split hub 91 is visible in FIG. 8A. Hub 91 and 93 may be made of aluminum or other suitable material. A circular opening 120 extends through the center of hubs 91 and 93 to accommodate shaft 80. Split ring 97 surrounds hubs 91 and 93 and is split to enable the ring 97 to be compressed to secure the torque limiter 92 on shaft 80. Split ring 97 may be made of nylon or other suitable material to function as a split ring under compression. Outside ring clamp 95 surrounds split ring 97 and may be clamped tightly on ring 97 by a bolt 122 extending through a pinch member 124. Clamp ring 95 may be made of cast stainless steel or other suitable material.

Torque limiter 92 is useful in preventing damage to the pool cover motor and other elements in the system in the event that the pool cover becomes jammed or the system otherwise cannot continue to rotate. In that case, the torque limiter acts as a breaker to prevent system damage. When the torque becomes greater than the clamping pressure of the ring clamp 95, torque limiter 92 will allow slippage between the hub 91, 93 and the split ring 97. Outside ring claim 95 may be tightened so that torque limiter 92 may withstand any amount of torque desired. Typical thresholds where one might want to begin slippage could be in the range of from 400 inch pounds up to 1100 inch pounds.

The torque limiter 92 has a base mount 99 on top of ring clamp 95. The shift base 94 is secured on base mount 99 by a bolt 126 extending through a hole 127 in base mount 99, a corresponding hole 129 in shift base 94 and secured by a nut 128. The shift arm 96 is pivotally secured on the shift base 94 by a bolt 130 extending through a hole (not shown) in pivot mount 98 to connect to a nut (not shown). The shift base 94 is mounted on base mount 99 so that the shift arm 96 pivots at a 45 degree angle relative to the vertical axis of torque limiter 92. This enables the shift arm 96 to fall with the force of gravity against one of the lugs to drive either the reel unit 72 or the drive cone unit 82, as described in connection with FIGS. 3 and 4.

Figure 8B:
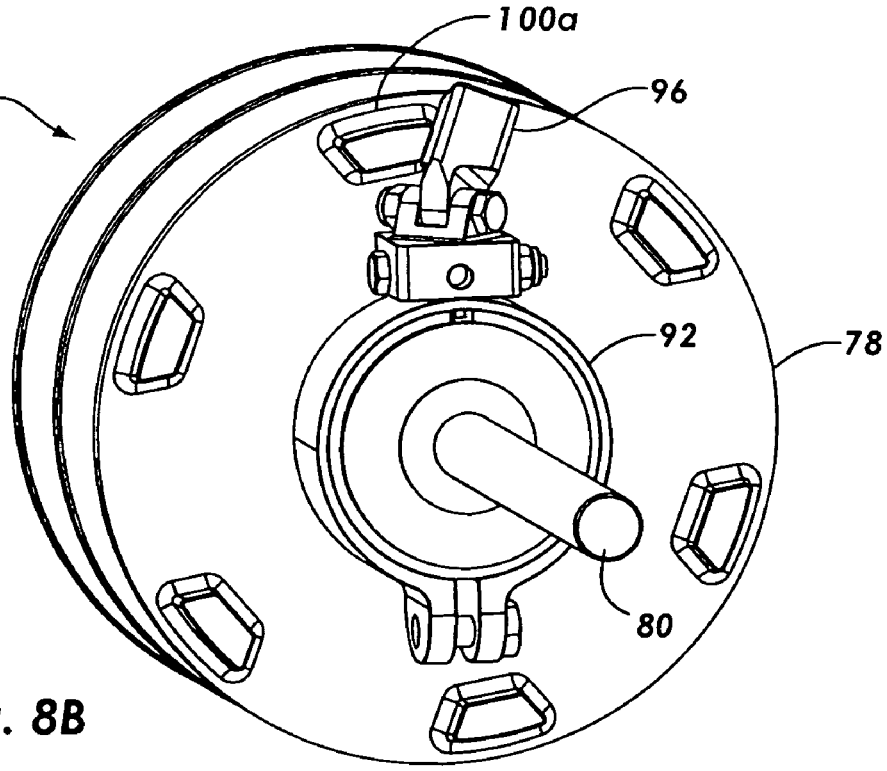
FIG. 8B is a perspective view of the torque limiter of FIG. 8A and reel assembly of the pool cover motor assembly shown in FIGS. 3 and 4.

FIG. 8B shows torque limiter 92 mounted on drive shaft 80. The shift arm 96 has pivoted to contact one of the reel disc lugs 100*a*, so as to drive reel unit 72 in a counter-clockwise rotation, as described in connection with FIG. 3.

Left-hand Pool Cover Motor System

Figure 9A:
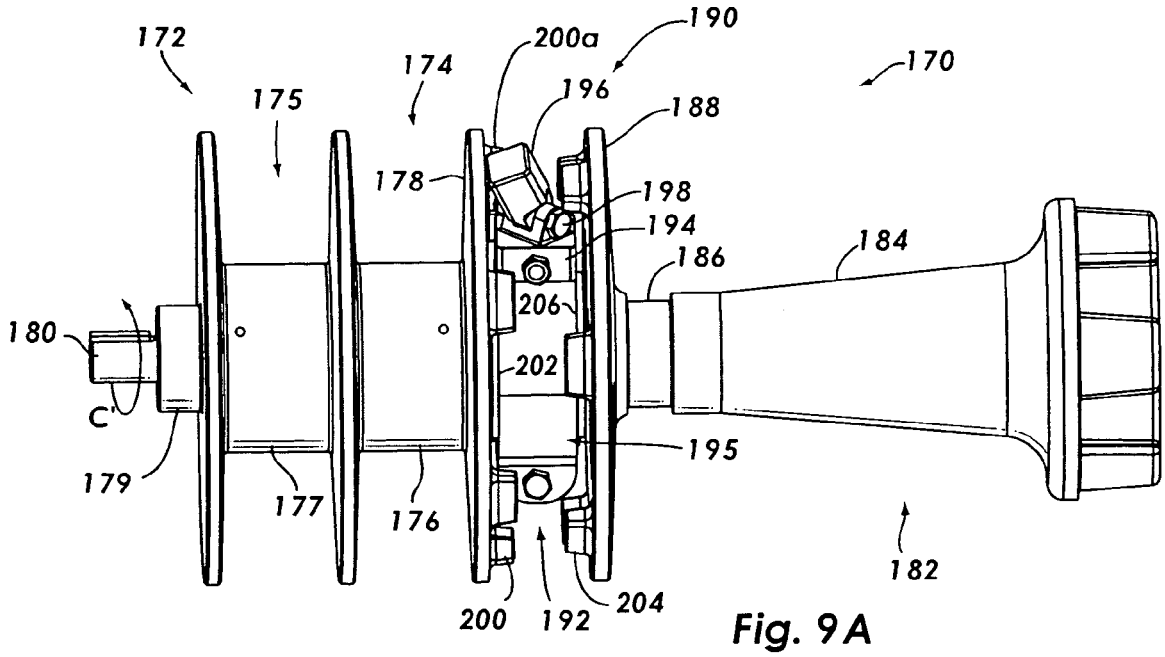
FIG. 9A is a plan partial view of a left-hand pool cover motor assembly, with a shift arm in a first position, in accordance with the present disclosure.
Figure 9B:
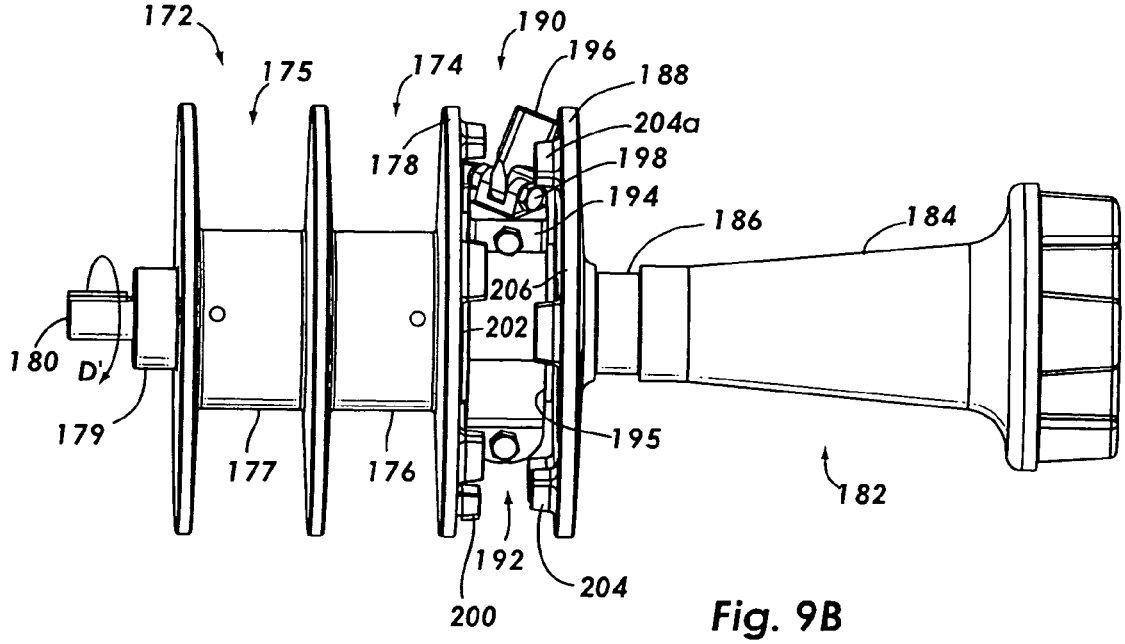
FIG. 9B is a plan partial view of the left-hand pool cover motor assembly of FIG. 9A, with the shift arm in a second position, in accordance with the present disclosure.

FIGS. 9A and 9B partially show a left-hand pool cover motor system 170 according to another embodiment. This system is essentially a mirror image of the right-hand pool cover motor system shown in FIGS. 3 and 4. As a result, the reference numbers used for similar element are offset by 100. Motor system 170 includes a rope reel unit 172 having dual side-by-side reels 174, 175 for collecting ropes on spindles 176, 177 from each of the two sides of a pool cover (not shown). Reel unit 172 is mounted on a bushing 179 to freely turn on a drive shaft 180 which comes from a pool cover motor (not shown). One side of reel 174 comprises a reel disc 178, for interfacing with the gear mechanism to be discussed later.

A drive cone unit 182 is also mounted to freely turn on drive shaft 180 and attached to a roll-up tube (not shown) to the right of drive cone unit 182 for collecting the pool cover. Drive cone unit 182 includes a cone piece 184 that is connected to a neck piece 186 and then to a drive cone disc 188. Drive cone disc 188 interfaces with the gear mechanism, as discussed below. As can be seen the pool cover motor system 170 is a left-hand system because the pool cover motor is on the left side and the roll-up tube is on the right-hand side of the system.

A gear mechanism 190 is shown between reel disc 178 and drive cone disc 188. The gear mechanism includes a torque limiter 192 resistively mounted on drive shaft 180 by clamp ring 195, to be discussed more later. A shift base 194 is mounted on torque limiter 192 and a shift arm 196 pivotally mounted on shift base 194. Reel disc lugs 200 are spaced around the surface 202 of reel disc 178 that faces toward gear mechanism 190. Likewise drive cone disc 188 includes drive cone disc lugs 204 spaced around the surface 206 of drive cone disc 188 that faces toward gear mechanism 190.

Shift arm 196 is mounted on a pivot mount 198 on shift base 194 so that the shift arm 196 pivots at 45 degrees relative to the axis of the drive shaft 180. The pivot action of shift arm 196 responds to the pull of gravity to fall against the reel disc lugs 200 as the drive shaft 180 rotates in the direction C' (counter-clockwise, looking in from the end of shaft 180) as shown in FIG. 9A. This pivot action rotates torque limiter 192 that is fixedly mounted on drive shaft 180. The rotation of torque limiter 192 places shift arm 196 in front and in contact with reel disc lug 200*a*, thereby driving reel unit 172 also in direction C. This rotation causes the rope (not shown) to wind up on reel unit 172 by coming in at the bottom of reels 176 and 177, similar to that shown in FIG. 3, except that system 170 is a left-hand system.

Referring now to FIG. 9B, the same portion of a pool cover motor system 170 is shown with the same components shown and described with respect to FIG. 9A. However, in FIG. 9B, the drive shaft 180 is shown rotating in the direction D' (clockwise, looking in from the end of the shaft 180). This rotational direction D' causes torque limiter 192 to rotate in the D' direction. The pull of gravity causes shift arm 196 to shift behind and in contact with lug 204*a* on cone drive disc 188 thereby causing it to rotate. This rotation of drive disc 188 causes cone drive 182 and roll-up tube (not shown) to rotate in the D direction, thereby collecting the pool cover that comes in at the top of roll-up tube, similar to that shown in FIG. 4, except that system 170 is a left-hand system.

The foregoing description further shows the simplicity and genius of the gear mechanism 90. The reel unit and the roll-up tube are selectively driven by the shift arm 196, depending on the direction of rotation of drive shaft 180. The only moving part is shift arm 196, which simply pivots one of two directions to make contact with one of the appropriate lugs. The direction of rotation determines whether the reel unit 172 is to be driven to collect the rope, thereby extending the pool cover, or whether the drive cone unit 182 is to be driven to retract the pool cover.

Further, the present invention enables the use of a gear mechanism 190 that is the same as the gear mechanism 90, shown in FIGS. 3 and 4 except that the shift arm 196 has been rotated by 90 degrees to fall with the pull of gravity in a manner opposite to that described for a right-hand system.

Figure 10A:
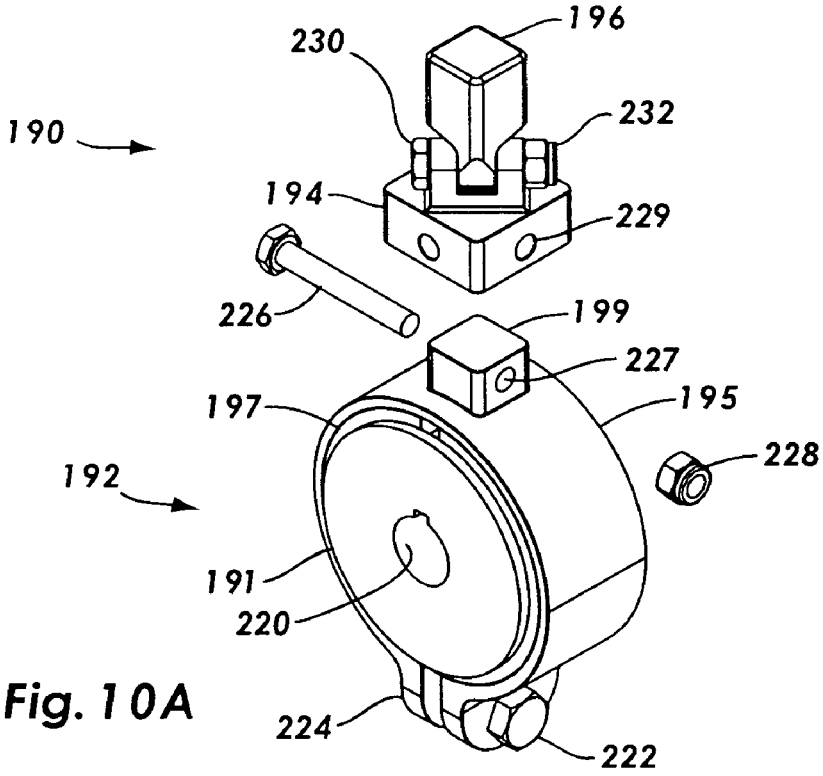
FIG. 10A is an exploded perspective view of the torque limiter of a left-hand pool cover motor assembly in accordance with the present disclosure.
Figure 10B:
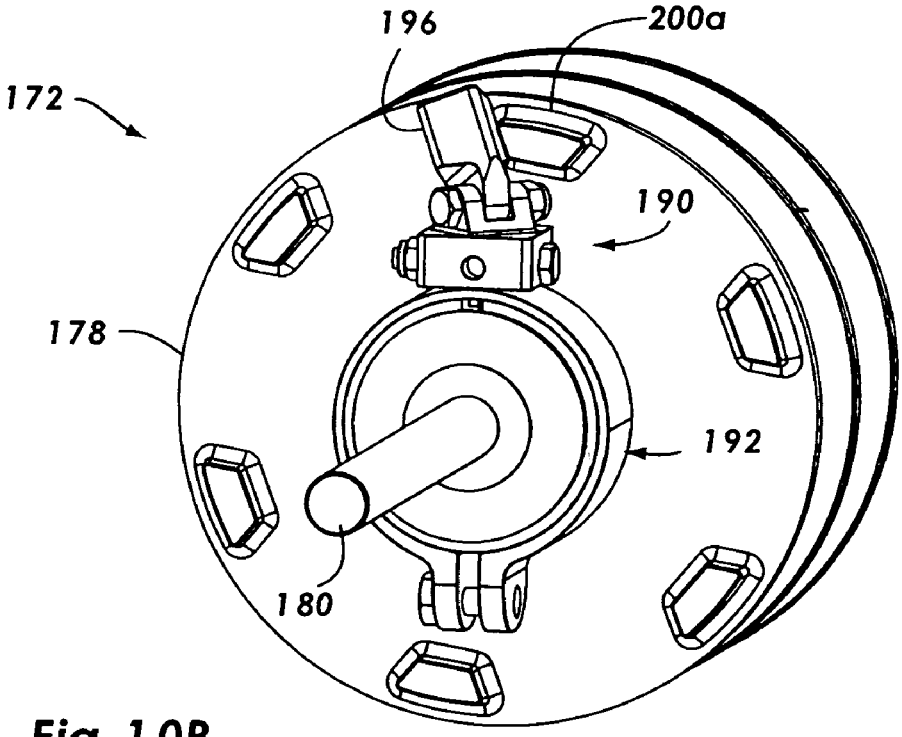
FIG. 10B is a perspective view of the torque limiter of FIG. 10A and the reel assembly of the left-hand pool cover motor assembly shown in FIG. 9A.

FIGS. 10A and 10B illustrate more clearly the ease in shifting or transposing the gear mechanism of the present embodiments so as to accommodate a left-hand system, rather than a right-hand system. FIGS. 10A and 10B show a left-hand system in contrast to the right-hand arrangement shown in FIGS. 8A and 8B. FIG. 10A shows the torque limiter 192 that includes a split hub 191 and a second split hub 193 (not shown) on the opposite side of the torque limiter. A circular opening 220 extends through the center of hubs 191 and 193 to accommodate shaft 180. Split ring 197 surrounds hubs 191 and 193, being split to enable the ring 197 to be compressed to secure the torque limiter 192 on shaft 180. Outside ring clamp 195 surrounds split ring 197 and may be clamped tightly on ring 197 by a bolt 222 extending through a pinch member 224.

The torque limiter 192 has a base mount 199 on top of ring clamp 195. The shift base 194 is secured on base mount 199 by a bolt 226 extending through a hole 227 in base mount 199 and a corresponding hole 229 in shift base 194 and then secured by a bolt 228. The shift arm 196 is pivotally secured on the shift base 194 by a bolt 230 extending through a hole in pivot mount 198 to connect to a nut 232. As shown, the shift base 194 is mounted on base mount 199 so that the shift arm 196 pivots at a 45 degree angle relative to the vertical axis of torque limiter 192. This enables the shift arm 196 to fall with the force of gravity against one of the lugs to drive either the reel unit 172 or the drive cone unit 182, as described with respect to FIGS. 8A and 8B.

Since the shift arm 196 for the left-hand system has been rotated 90 degrees relative to the shift arm 96 for a right-hand system, shift arm 196 will pivot and fall in response to gravity 90 degrees differently than discussed with respect to a right-hand system. However, since a left-hand system has the pool cover motor system components located in a mirror image to a right-hand system, the shift arm 196 still falls in the correct directions to drive the reel assembly 172 and the drive cone assembly 182 correctly for a left-hand system, as described above.

FIG. 10B shows torque limiter 192 mounted on drive shaft 180. The shift arm 196 has pivoted to contact the reel disc lug 200*a*, so as to drive reel unit 172 in a counter-clockwise rotation, as further described in connection with FIG. 9A.

In summary, the pool cover motor systems of the present embodiments offer a number of advantages. The gear mechanisms 90 and 190 for right-hand and left-hand systems of the present embodiments use simple components with only one moving part that pivots in response to gravity. Moreover, gear mechanisms 90 and 190 use the same components. Gear mechanism 90, shown in FIG. 8A can easily be changed to become gear mechanism 190 shown in FIG. 10A by simply removing bolt 126 and rotating shift base 94 by 90 degrees relative to base mount 99 to place it in the position of shift base 194 shown in FIG. 10A. This simple gear structure eliminates the need to stock separate right-hand and left-hand pool cover motor assemblies. One pool cover motor assembly functions as either a right-hand or left-hand assembly by simply changing the gear mechanism as described above.

A further simplification over the prior art is provided by mounting the torque limiters 92 and 192 on drive shafts 80 and 180, respectively, to connect to the respective gear mechanism 90 and 190. Thus, the torque limiter provides the necessary fixed connection of the gear mechanism to the drive shaft, as described above. Accordingly, the use of a torque limiter connected to the gear mechanism performs both the functions of securing the gear mechanism to the drive shaft and limiting the amount of torque applied to the gear mechanism and to the pool cover motor assembly generally. This structure substantially simplifies the task of including a torque limiter as part of the pool cover motor assembly and reduces the cost of manufacturing accordingly.

While this disclosure has been described as having a preferred design, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A universal shift apparatus for a swimming pool cover motor having a rotatable drive shaft and a rope attached to the end of the swimming pool cover, comprising:

(a) a reel unit mounted to freely rotate about the rotatable drive shaft;

(b) a drive cone unit mounted to freely rotate about the rotatable drive shaft;

(c) a gear mechanism driven by the rotatable drive shaft, and adapted for driving the reel unit in a first rotational direction as the drive shaft rotates in a first direction, and adapted for driving the drive cone unit in a second rotational direction as the drive shaft rotates in a second direction; and (d) a shift member associated with the gear mechanism to selectively reverse the first rotational direction of the reel unit and to selectively reverse the second rotational direction of the drive cone unit, wherein the shift member is adapted to pivot in one direction to engage the reel unit when the rotatable drive shaft is rotated in the first direction and is adapted to pivot in a second direction to engage the drive cone unit when the rotatable drive shaft is rotated in the second direction.

2. The apparatus of claim 1, wherein the reel unit is adapted to collect the rope and extend and swimming pool cover as the shaft moves in the first rotational direction, and the drive cone unit is adapted to collect and retract the swimming pool cover as the shaft moves in the second rotational direction.

3. The apparatus of claim 1, wherein the gear mechanism includes a shift base on the rotatable drive shaft for mounting the shift member to enable the shift member to pivot with the pull of gravity.

4. The apparatus of claim 3, wherein the shift member is mounted on the shift base so as to pivot at approximately 45 degrees with respect to the longitudinal axis of the rotatable drive shaft.

5. The apparatus of claim 1, wherein the gear mechanism comprises a shift base configured to transform the gear mechanism to drive the drive cone unit as the rotatable drive shaft rotates in the first direction, and to transform the gear mechanism to drive the reel unit as the rotatable drive shaft rotates in the second direction.

6. The apparatus of claim 5, wherein the shift base is adapted to be removably attached to the rotatable drive shaft, and the gear mechanism is attached to the shift base.

7. The apparatus of claim 6, wherein the shift base is adapted to be removably attached to the rotatable drive shaft in a first position and a second position.

8. The apparatus of claim 7, wherein the second position of the shift base on the rotatable drive shaft is disposed approximately 90 degrees from the first position.

9. The apparatus of claim 1, further comprising a torque limiter mounted on the rotatable drive shaft and connected to the gear mechanism to drive the gear mechanism in response to rotation of the rotatable shaft, wherein the gear mechanism includes the shift member.

10. A universal shift apparatus, comprising:

(a) a rotatable drive shaft;

(b) a reel unit mounted to freely rotate about the rotatable drive shaft;

(c) a drive cone unit mounted to freely rotate about the rotatable drive shaft; and (d) a gear mechanism mounted to be driven by the rotatable drive shaft, the gear mechanism including a shift member configured to pivot to a first position to engage and drive the reel unit as the rotatable drive shaft moves in a first rotational direction and to pivot to a second position to engage and drive the drive cone unit as the rotatable drive shaft moves in a second rotational direction.

11. The apparatus of claim 10, wherein the reel unit includes first drive lugs thereon for engaging the shift member as the rotatable drive shaft moves in the first rotational direction.

12. The apparatus of claim 10, wherein the drive cone unit includes second drive lugs thereon for engaging the shift member as the rotatable drive shaft moves in the second rotational direction.

13. The apparatus of claim 10, wherein the shift member is mounted on a shift base of the gear mechanism to pivot in response to gravity.

14. The apparatus of claim 10, wherein the shift member is configured to pivot at approximately a 45 degree angle in a first direction relative to the longitudinal axis of the rotatable drive shaft.

15. The apparatus of claim 10, wherein the shift member is configured to pivot at approximately a 45 degree angle in a second direction relative to the longitudinal axis of the rotatable drive shaft.

16. The apparatus of claim 10, further comprising a torque limiter resistively mounted on the rotatable drive shaft, wherein the gear mechanism is mounted on the torque limiter.

17. The apparatus of claim 16, wherein the torque limiter comprises a hub connected to the rotational drive shaft, the hub being in compression by a ring clamp around the hub.

18. The apparatus of claim 17, wherein the torque limiter further comprises a split ring between the hub and the ring clamp.

19. The apparatus of claim 16, further comprising a shift base mounted on the torque limiter, the shift member being mounted on the shift base, wherein the shift base is configured to selectively change the orientation of the shift member to engage and drive the drive cone unit as the rotatable drive shaft moves in the first rotational direction and to engage and drive the reel unit as the rotatable drive shaft moves in the second rotational direction.

20. The apparatus of claim 10, wherein the gear mechanism includes a shift base, and wherein the shift member is pivotably mounted on the shift base.

21. The apparatus of claim 20, wherein the shift member is configured to pivot on the shift base to selectively engage the reel unit or the drive cone unit.

22. The apparatus of claim 20, wherein the shift base is configured to be removably mounted on the rotatable drive shaft in a first base position or a second base position.

23. The apparatus of claim 22, wherein the second base position is disposed approximately 90 degrees from the first base position.

24. The apparatus of claim 22, wherein the first base position of the shift base orients the shift member to engage the reel unit as the rotatable drive shaft rotates in the first rotational direction and to engage the drive cone unit as the rotatable drive shaft rotates in the second rotational direction, and wherein the second base position of the shift base orients the shift member to engage the drive cone unit as the rotatable drive shaft rotates in the first rotational direction and to engage the reel unit as the rotatable drive shaft rotates in the second rotational direction.

25. A method for adapting a reel apparatus for a swimming pool cover motor having a rotatable drive shaft and a rope attached to the end of the swimming pool cover, comprising:

(a) collecting the rope on a reel unit, the reel unit being mounted to freely rotate about the rotatable drive shaft;

(b) collecting the swimming pool cover on a roll-up tube being driven by a drive cone unit, the drive cone unit being mounted to freely rotate about the rotatable drive shaft;

(c) driving the reel unit in a first rotational direction as the rotatable drive shaft rotates in a first direction, and driving the drive cone unit in a second rotational direction as the rotatable drive shaft rotates in a second direction;

(d) pivoting a shift member in a first pivoting direction to engage the reel unit as the rotatable drive shaft rotates in the first direction;

(e) pivoting the shift member in a second pivoting direction to engage the drive cone unit as the rotatable drive shaft rotates in the second direction; and (f) selectively reversing the first rotational direction of the reel unit and the second rotational direction of the drive cone unit.

26. The method of claim 25, wherein the rope is collected to extend the swimming pool cover as the rotatable drive shaft moves in the first rotational direction, and the motor cover is collected as the rotatable drive shaft moves in the second rotational direction.

27. The method of claim 25, further comprising the step of mounting the shift member to enable the shift member to pivot with the pull of gravity.

28. The method of claim 25, further comprising mounting the shift member on a shift base so that the shift member can pivot at approximately 45 degrees with respect to the longitudinal axis of the rotatable drive shaft.

29. The method of claim 25, further comprising changing the orientation of the shift member to drive the drive cone unit as the rotatable drive shaft rotates in the first direction, and to drive the reel unit as the rotatable drive shaft rotates in the second direction.

30. The method of claim 29, wherein the change of orientation step comprises removably attaching the shift member on the rotatable drive shaft alternately in a first position or in a second position.

31. The method of claim 30, wherein the second position of the shift member on the rotatable drive shaft is disposed approximately 90 degrees from the first position.

32. The method of claim 25, further comprising mounting a torque limiter on the rotatable drive shaft in association with the shift member.

33. A shift apparatus for a swimming pool cover motor having a rotatable drive shaft and a rope attached to the end of the swimming pool cover, comprising:

(a) a reel unit mounted to freely rotate about the rotatable drive shaft;

(b) a drive cone unit mounted to freely rotate about the rotatable drive shaft;

(c) a gear mechanism driven by the rotatable drive shaft, the gear mechanism including a shift member configured to pivot to a first position to engage and drive the reel unit in a first rotational direction as the rotatable drive shaft rotates in a first direction and to pivot to a second position to engage and drive the drive cone unit in a second rotational direction as the rotatable drive shaft rotates in a second direction; and (d) a torque limiter mounted on the rotatable drive shaft and connected to the gear mechanism to drive the gear mechanism in response to rotation of the rotatable drive shaft.

34. The shift apparatus of claim 33, wherein the torque limiter is connected to the gear mechanism to limit the amount of torque applied to the gear mechanism.

35. The shift apparatus of claim 33, wherein the torque limiter comprises a hub connected to the rotatable drive shaft, the hub being in compression by a ring clamp around the hub.

36. The shift apparatus of claim 35, further comprising a split ring between the hub and the ring clamp.

37. The shift apparatus of claim 33, wherein the gear mechanism is mounted on the torque limiter.

* * * * *

UNITED STATES PATENT AND TRADEMARK OFFICE

CERTIFICATE OF CORRECTION

PATENT NO. : 7,093,784 B2
APPLICATION NO. : 10/686111
DATED : August 22, 2006
INVENTOR(S) : Lanny R. Smith It is certified that error appears in the above-identified patent and that said Letters Patent is hereby corrected as shown below:

Column 11, Line 21, Claim 26 change “motor cover” change to -- swimming pool--

Signed and Sealed this

Twenty-sixth Day of December, 2006

JON W. DUDAS
*Director of the United States Patent and Trademark Office*